US008668292B2

(12) United States Patent
Pae

(10) Patent No.: US 8,668,292 B2
(45) Date of Patent: Mar. 11, 2014

(54) REFRIGERATOR AND REFRIGERATOR DOOR

(75) Inventor: Chanju Pae, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 149 days.

(21) Appl. No.: 12/918,083

(22) PCT Filed: Dec. 30, 2008

(86) PCT No.: PCT/KR2008/007806

§ 371 (c)(1),
(2), (4) Date: Aug. 18, 2010

(87) PCT Pub. No.: WO2009/104867

PCT Pub. Date: Aug. 27, 2009

(65) Prior Publication Data

US 2010/0327720 A1 Dec. 30, 2010

(30) Foreign Application Priority Data

Feb. 21, 2008 (KR) ..... 10-2008-0015771

(51) Int. Cl.
*A47B 96/04* (2006.01)

(52) U.S. Cl.
USPC ..... 312/405; 312/116

(58) Field of Classification Search
USPC ..... 312/116, 405, 223.5, 401, 405.1; 40/541, 544, 546, 606.04
See application file for complete search history.

(56) References Cited

U.S. PATENT DOCUMENTS 5,027,258 A * 6/1991 Schoniger et al. ..... 362/629
5,358,326 A * 10/1994 Cherry et al. ..... 312/405
5,520,453 A * 5/1996 Aoki et al. ..... 312/406
6,705,033 B1 * 3/2004 Greene et al. ..... 40/546
6,736,534 B1 * 5/2004 Fite ..... 362/576
7,878,022 B2 * 2/2011 Kwon ..... 62/389
8,104,853 B2 * 1/2012 Kim et al. ..... 312/405
8,439,461 B2 * 5/2013 Kim ..... 312/405
2002/0007576 A1 * 1/2002 Gai ..... 40/546
2004/0183414 A1 * 9/2004 Kwon ..... 312/401
2005/0006997 A1 * 1/2005 Yoshioka ..... 312/405
2006/0250060 A1 * 11/2006 Rose et al. ..... 312/401
2007/0062085 A1 * 3/2007 Pan ..... 40/546
2007/0124970 A1 * 6/2007 Hjaltason ..... 40/546

(Continued)

FOREIGN PATENT DOCUMENTS

CN 2566200 Y 8/2003
KR 10-2006-0013202 A 2/2006

OTHER PUBLICATIONS

English translation of KR 1999-0027380.*
Chinese Office Action dated Oct. 17, 2011 for Application No. 200880127350.7, with English translation, 12 pages.

(Continued)

*Primary Examiner* — Daniel Rohrhoff
(74) *Attorney, Agent, or Firm* — Fish & Richardson P.C.

(57) ABSTRACT

There is provided a door of a refrigerator including: a door assembly which defines the appearance of the refrigerator door; an exterior member which is provided ahead of the door assembly to emit light; a connection member which connects the exterior member to the door assembly; a connection space which is formed between the door assembly and connection member; and a light-emitting means which is disposed at the connection space and emits light to the exterior member. There is an advantage in that it is possible to prevent dazzling of users, since the exterior member is not exposed to the outside and light is emitted via an end of the exterior member.

14 Claims, 4 Drawing Sheets

(56) References Cited

U.S. PATENT DOCUMENTS

| | | | | |
|---|---|---|---|---|
| 2007/0144047 | A1* | 6/2007 | Singh | 40/633 |
| 2007/0245607 | A1* | 10/2007 | Awai et al. | 40/546 |
| 2008/0024047 | A1* | 1/2008 | Juo et al. | 312/405 |
| 2008/0143227 | A1* | 6/2008 | Kim et al. | 312/405 |
| 2010/0270901 | A1* | 10/2010 | Kim et al. | 312/405 |
| 2010/0327720 | A1* | 12/2010 | Pae | 312/405 |
| 2011/0089790 | A1* | 4/2011 | Lee et al. | 312/109 |
| 2012/0011754 | A1* | 1/2012 | Matyear | 40/541 |

OTHER PUBLICATIONS

International Search Report dated Apr. 28, 2009 for Application No. PCT/KR2008//007806, 2 pages.

English Abstract of KR 10-2006-0062068, dated Jun. 12, 2006, 2 pages.

English Abstract of KR 20-1999-0027380, dated Jul. 15, 1999, 2 pages.

English Abstract of KR 20-1999-0036003, dated Sep. 15, 1999, 1 page.

* cited by examiner

REFRIGERATOR AND REFRIGERATOR DOOR

TECHNICAL FIELD

Embodiment relates to a refrigerator and a door thereof.

BACKGROUND ART

Generally, a refrigerator is an electronic appliance for keeping and storing foods for a long time by storing them in a storage space inside the refrigerator, closed by a refrigerator door, at low temperature.

The refrigerator is configured to preserve the foods stored in the storage space by supplying cool air, which is generated by the heat exchange with a refrigerant circulating a refrigeration cycle, into the storage space.

Recently, this kind of refrigerator is in a trend of becoming larger and multi-functional in connection with diversification of dietary pattern, and therefore products with various specifications and types are released onto the market.

Further, exterior design as well as function serve as a key factor of buying the refrigerator, and therefore refrigerators having various colors and patterns are developed.

In typical, various colors and patterns may be printed on a front surface of a refrigerator main body and a door. And, the whole or some of the main body or door may be made of tempered glass to give the refrigerator a feeling of luxury.

Meanwhile, according to the conventional refrigerator, there is a problem in that the location of the refrigerator is hardly recognized if intensity of illumination at a site, where the refrigerator is installed, is low.

Particularly, there is a problem in that users can hardly recognize the location of the refrigerator door, which is operated to take in or out the foods, thereby causing inconvenience in use.

DISCLOSURE OF INVENTION

Technical Problem

An object of the present invention is to provide a refrigerator and a refrigerator door in which an exterior member defining the appearance of the refrigerator is allowed to emit light by a light-emitting means.

Also, another object is to provide a refrigerator and a refrigerator door in which an exterior member, which is emitting light, is not exposed to the outside.

Technical Solution

To achieve these objects and other advantages and in accordance with the purpose of the invention, as embodied and broadly described herein, there is provided a door of a refrigerator including: a door assembly which defines the appearance of the refrigerator door; an exterior member which is provided ahead of the door assembly to emit light; a connection member which connects the exterior member to the door assembly; a connection space which is formed between the door assembly and connection member; and a light-emitting means which is disposed at the connection space and emits light to the exterior member.

Also, in another aspect of the present invention, there is provided a door of a refrigerator including: an out-door which defines a front appearance; an exterior member which is provided ahead of the out-door and onto which light is incident; a connection member which connects at least one side of the exterior member to the out-door; and a light-emitting means which is provided at one side of the exterior member and emits light in a longitudinal direction of the exterior member.

Also, in further another aspect of the present invention, there is provided a refrigerator including: a main body in which a storage chamber is formed; a door which selectively closes the storage chamber; an exterior member which is provided at one side of the main body or door, and onto which light is incident; and a light-emitting means which is provided at at least one side of the exterior member and emits light toward the exterior member.

Advantageous Effects

According to a refrigerator door of the present embodiment, there is an advantage in that the location of the refrigerator door can be easily recognized because an exterior member is light emitted by a light-emitting means.

Also, there is an advantage in that it is possible to prevent dazzling of users, since the exterior member is not exposed to the outside and light is emitted via an end of the exterior member.

Also, there is an effect in that aversion to the light directly incident from the light-emitting means to the front can be minimized and users feel comfortable, since the light is emitted into the exterior member.

Also, the light emitted through the exterior member acts as an indirect light source such as a mood lamp, thereby further enhancing the appearance.

Also, in case patterns are expressed on the exterior member, the patterns stand out because of the dispersion and diffusion effects of light, and the appearance of the refrigerator is expected to be further sophisticated.

MODE FOR THE INVENTION

Hereinafter, exemplary embodiments of the present invention will be described in detail with reference to the accompanying drawings. However, it is to be pointed out that the embodiments of the present invention do not limit the scope of the invention, but on the contrary it has to be understood that many modifications, additions, variations or substitutions may be resorted to the present invention, without altering its spirit or departing from its scope of protection, as it is defined in the appended claims.

Figure 1:
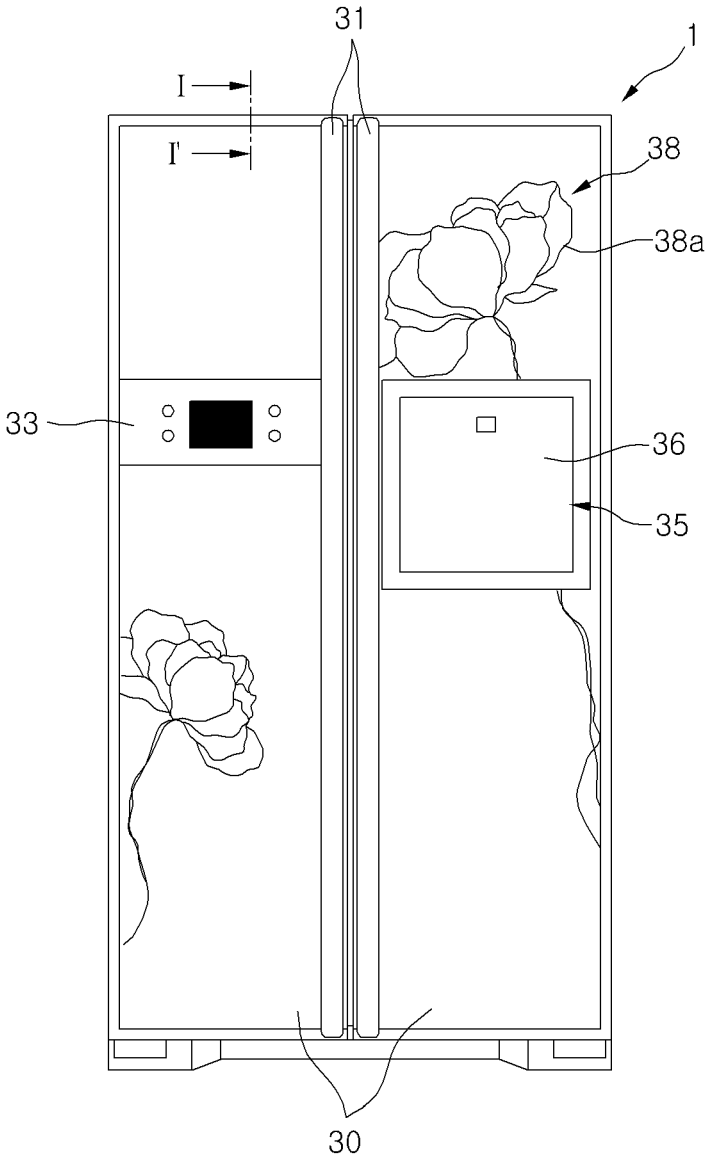
FIG. 1 is a perspective view showing the appearance of a refrigerator according to a first embodiment of the present invention.

FIG. 1 shows the appearance of a refrigerator according to a first embodiment of the present invention in a perspective view.

Referring to FIG. 1, the refrigerator 1 according to the first embodiment of the present invention includes a main body (not shown) in which a storage chamber is formed, and a door 30 which selectively close an opened front surface of the main body.

In detail, the door 30 includes a display unit 33 which displays the operational state of the refrigerator. The display unit 33 may include a video unit which displays images, and a plurality of input units which allow specific commands to be inputted.

Also, the door 30 is provided with a home bar 35 for easily taking in-and-out goods. The home bar 35 includes a storage space (not shown) of the goods, and a home bar door 36 which is rotatably coupled to a front of the storage space.

Goods to be frequently taken out may be stored in the storage space, and the goods may be taken out of the storage space by opening the home bar door 36, whenever the need arises.

Meanwhile, a handle 31 capable of being grasped by users to operate the door 30 is provided at a front surface of the door 30.

And, a patterned part 38 for improving aesthetic appearance of the refrigerator may be formed at the door 30. On the patterned part 38, various colors and patterns may be realized.

Figure 2:
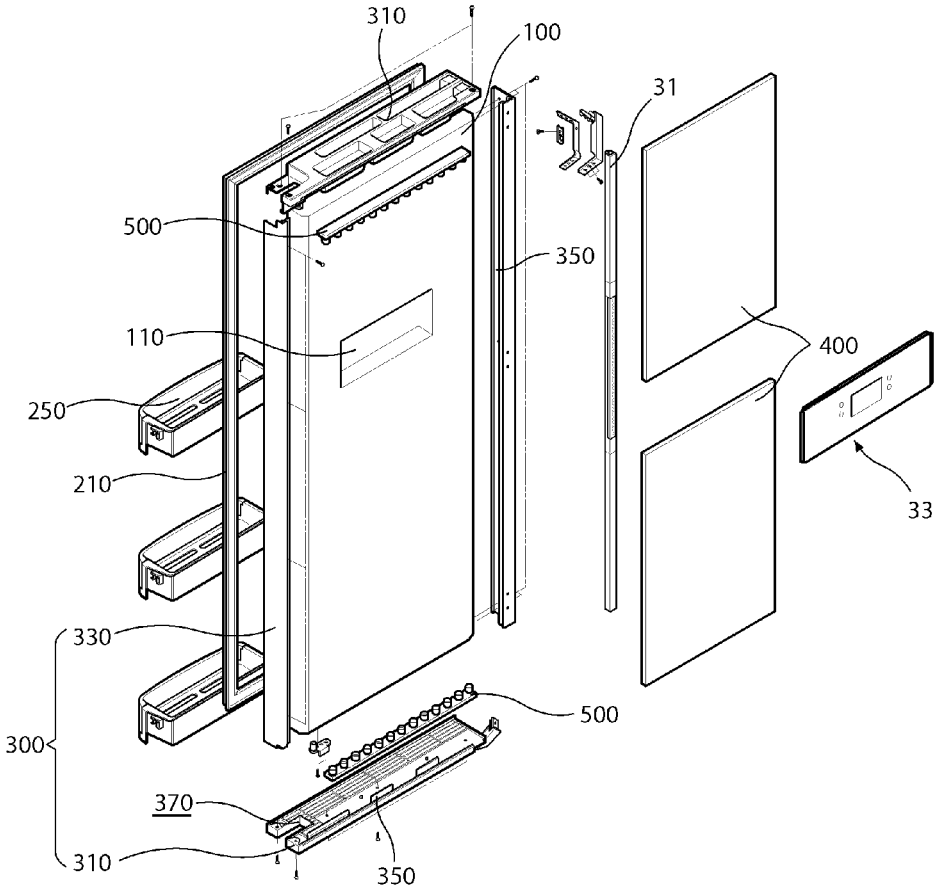
FIG. 2 is an exploded perspective view showing the construction of a refrigerator door according to the first embodiment of the present invention.
Figure 3:
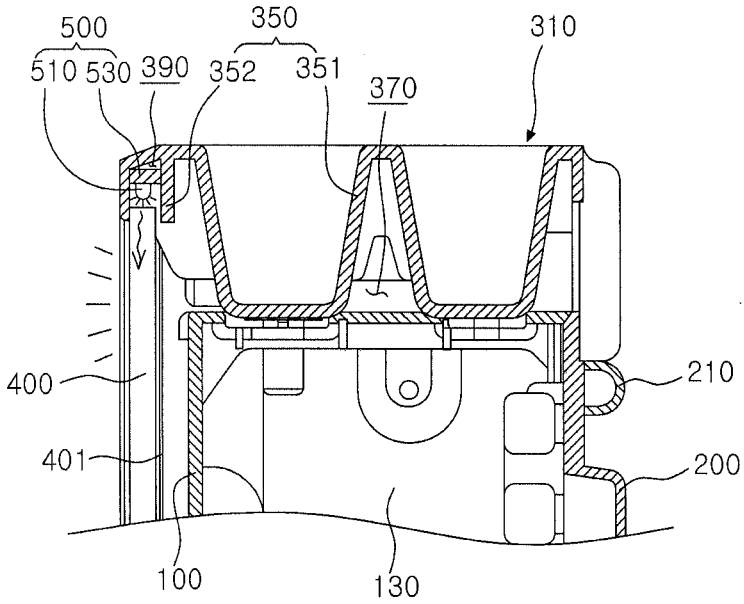
FIG. 3 is a cross-sectional view taken along line I-I' of FIG. 1.

FIG. 2 shows the construction of a refrigerator door according to the first embodiment of the present invention in an exploded perspective view, FIG. 3 shows a cross-sectional view taken along line I-I' of FIG. 1.

Referring to FIGS. 2 and 3, the door 30 according to the first embodiment of the present invention includes an outdoor panel 100 defining a front appearance of the door 30, a door liner 200 defining the other surface of the door 30, an exterior member 400 provided ahead of the outdoor panel 100, and a connection member 300 for connecting the exterior member 400 to the outdoor panel 100.

In detail, the outdoor panel 100 may be made of a steel plate having a rectangular shape. And, a display mounting portion 110 where the display unit 33 is installed may be formed in the outdoor panel 100.

The door liner 200 forms an interior appearance of the door 30. And, a plurality of baskets 250 for accommodating goods may be connected to the door liner 200.

Further, a gasket 210, which seals between a storage space of the refrigerator and the door 30 in a state where the door 30 is closed, is provided at the rear edges of the door liner 200. The gasket 210 may be made of elastic material.

Between the outdoor panel 100 and the door liner 200, an insulating material 130 for preventing cool air in the refrigerator from leaking to the outside is interposed. The outdoor panel 100 and door liner 200 may be assembled in a state where the insulating material 130 is interposed therebetween.

Hereinafter, an assembly of the outdoor panel 100 and door liner 200 is referred to as a door assembly 100, 200.

Meanwhile, the exterior member 400 is provided ahead of the door assembly 100, 200, and the number thereof may be more than two. Here, the exterior member 400 may be made of tempered glass or plastic, which is transparent to light.

Various patterns may be printed on a front or rear surface of the exterior member 400. The printed patterns form the patterned part 38. The appearance of the door 30 may be improved by the patterned part 38.

Also, a separately printed sheet 401 may be provided at a rear side of the exterior member 400. In this case, the sheet may give the patterned part 38 a feeling of three- dimensional solidity. And, a decoration member 38*a* such as crystal or cubic may be attached to the sheet, thereby improving the appearance thereof.

Meanwhile, at least one side of the door assembly 100, 200, a connection member 300 for connecting the exterior member 400 to the door assembly 100, 200 is provided. The connection member 300 may be disposed along edges of the door assembly 100, 200, that is upper, lower, left and right sides thereof.

In detail, the connection member 300 includes a first connection member 310 which is disposed at upper and lower ends of the door 30, and a second connection member 330 which is disposed at left and right ends of the door.

There is a difference in shape between the first and second connection members 310, 330, however the connection structure between the door assembly 100, 200 and the exterior member 400 is the same as the above, and therefore the explanation about the connection member 300 can be applied to both of the first and second connection members 310, 330.

Front and rear ends of the first connection member 310 are bent in a predetermined direction, so that the first connection member is tightly connected to a front surface of the exterior member 400 and a rear surface of the door liner 200. And, the second connection member 330 may be also tightly connected to the front surface of the exterior member 400 and the rear surface of the door liner 200.

Also, the connection member 300 is provided with a plurality of connection ribs 350 extended in the direction of the door 30. Further, the plurality of connection ribs 350 include a first connection rib 351 connected to the door assembly 100, 200, and a second connection rib 352 connected to the exterior member 400.

Meanwhile, the door 30 includes a door assembly mounting portion 370 which is interposed between the first connection rib 351 and the door assembly 100, 200, and a exterior member accommodating portion 390 which is formed by the connection between the second connection rib 352 and the exterior member 400.

That is, the door assembly mounting portion 370 and exterior member accommodating portion 390 may be referred to as a connection space which is formed by the connection rib 350.

That is, the first connection rib 351 is disposed at the door assembly mounting portion 370 and is connected to the door assembly 100, 200, and the second connection rib 352 is disposed at the exterior member accommodating portion 390 and is connected to the exterior member 400.

In detail, the exterior member 400 may be slidably inserted into the exterior member accommodating portion 390.

And, at least some part of the exterior member 400, that is an edge of the exterior member 400 may be fastened by the second connection rib 352.

Referring to FIG. 3, a top end of the exterior member 400 is accommodated and fastened by the second connection rib 352, however a bottom end and side ends may also be fastened by the same construction as described above.

By way of connecting the exterior member 400, the exterior member 400 may define a front appearance of the door as being easily fixed to a front surface of the door 30.

Meanwhile, a light-emitting means 500 is provided between the exterior member 400 and the connection member 300. In other words, the light-emitting means 500 may be provided at a space between an edge of the exterior member 400 and the second connection rib 352.

The light-emitting means 500 may be a LED, and it is disposed to emit light toward an end of the exterior member 400, i.e. an edge of the exterior member 400.

In detail, the light-emitting means 500 includes a LED 510 for emitting light, and a board 530 on which the LED is mounted.

The board 530 is installed at an inner side of the exterior member accommodating portion 390, and a plurality of LEDs 510 may be provided in the exterior member accommodating portion 390. Here, the plurality of LEDs 510 may be continually mounted on one board 530.

However, the installing location of the board 530 is not restricted to the exterior member accommodating portion 390, and it may also be installed at an inside of the connection member by a separate mounting means.

Further, if the light-emitting means 500 can emit light to an outer end of the exterior member 400, the light-emitting means 500 may be mounted on inner side of the connection member 300 or one side of the outdoor panel 100.

Also, the light-emitting means 500 may also be another light source other than the LED.

The light-emitting means 500 may be provided at both of the first connection member 310, to which the exterior member 400 is attached, and the second connection member 330. In this case, the light-emitting means 500 may emit light from the whole edges of the exterior member 400 to the end of the exterior member 400.

Meanwhile, the light-emitting means 500 may also be provided at any one of the first and second connection members 310, 330 of the door 30. That is, in case the light-emitting means 500 is provided at the first connection member 310, light can be emitted from top and bottom ends of the door assembly 100, 200 in opposite directions.

In case the light-emitting means 500 is provided at the second connection member 330, light can be emitted from left and right ends of the door assembly 100, 200 in opposite directions.

That is, the light-emitting means 500 may be installed along at least one end of the top, bottom, left and right ends of the exterior member 400.

The light emitted from the light-emitting means 500 is transmitted into the exterior member 400 via the end of the exterior member 400. In this course, the whole surface or considerable portion of the exterior member 400 may emit light.

That is, since the light emitted from the light-emitting means 500 is not directly incident to the front but is incident in a longitudinal direction of the exterior member 400, and therefore it may prevent dazzling of users.

Also, as described above, the exterior member 400 may be partly print-processed. And, the permeability of light emitted from the light-emitting means 500 can be adjusted according to the level of print-processing.

That is, the amount of light emitted from the light-emitting means 500 can be adjusted according to the transparency of a portion, which is print-processed, of the exterior member 400.

Hereinafter, the operation of the refrigerator having the above configuration will be described with reference to the drawings.

In a state where the door 30 of the refrigerator 1 is closed, the exterior member 400 is exposed to a front surface of the refrigerator and forms the appearance thereof.

In case the intensity of illumination at a site where the refrigerator 1 is placed is high enough, the light-emitting means 500 provided in the door 30 of the refrigerator 1 does not operate. And, the patterns expressed on the exterior member 400 can be recognized from the outside, so that these stylish elements can be transferred to the users.

Meanwhile, in case the intensity of illumination at the site where the refrigerator 1 is placed is lower than a predetermined value, the site is dark and therefore a front surface of the door 30, i.e. the patterns expressed on the exterior member 400 cannot be recognized by the users.

Accordingly, in case the intensity of illumination in the room is lower than a predetermined value, the light-emitting means 500 may be turned-on by an operation of the users or by a sensor detecting the intensity of illumination. If the intensity of illumination is turned on, the light emitted from the light-emitting means 500 is transferred into the exterior member 400 via an end of the exterior member 400.

That is, strong light which is emitted from a location adjacent to the end of the exterior member 400 is incident onto the end of the exterior member 400 which is transparent or semi-transparent, and the incident light is transferred along the inside of the exterior member 400 so that a front surface of the exterior member 400 or corresponding portion is lighted up.

Here, in case the light-emitting means 500 is disposed along the whole ends of the exterior member 400, the exterior member 400 is generally brightened, and in case the light-emitting means 500 is disposed along one end of the exterior member 400, the exterior member 400 is locally brightened.

Of course, even if the light-emitting means 500 is disposed along the whole edges of the exterior member 400, it is possible to selectively light-up some part of the exterior member 400 by controlling the operation thereof.

Meanwhile, the print-processing which blocks light from passing is worked out on a surface of the exterior member 400, the other portion except for the print-processed portion may emit light out of the door 30.

Also, in case patterns for transmitting light is expressed on the surface of the exterior member 400, light can be transferred through the patterns.

If semi-transparent pigment or semi-transparent sheet capable of controlling the transparency of light is attached to a surface of the exterior member 400, the light emitted through the exterior member 400 can be controlled.

The users can recognize the location of the refrigerator 1 and handle 31 by the help of the light emitted through the exterior member 400. And, the refrigerator may also serve as an illumination apparatus, since light is emitted therefrom.

The refrigerator according to the present invention can be implemented in embodiments other than the above-described embodiments without departing from the spirit and major characteristics of the present invention, in particular the refrigerator main body can also be implemented in many embodiments. Therefore, another embodiment of the refrigerator according to the present invention will be explained with reference to the drawings.

The refrigerator according to another embodiment of the present invention has similar structure as that of the above-described refrigerator, except for the application. Therefore, in this embodiment, the detailed description of parts similar to those described above will be omitted and they will be identified by the same reference numerals.

Figure 4:
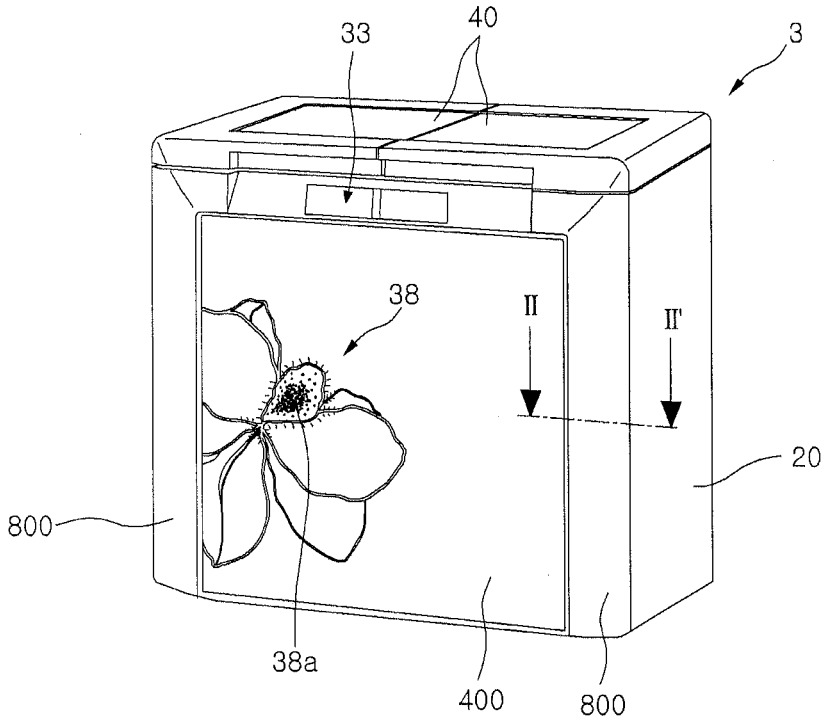
FIG. 4 is a perspective view showing the appearance of a refrigerator according to a second embodiment of the present invention.
Figure 5:
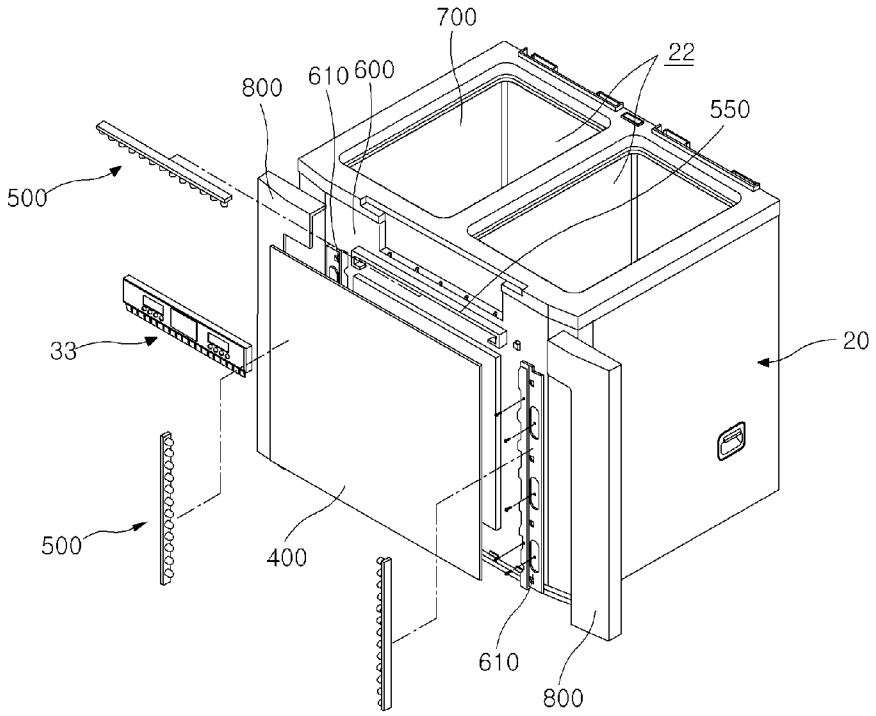
FIG. 5 is an exploded perspective view showing the construction of a refrigerator main body according to the second embodiment of the present invention.
Figure 6:
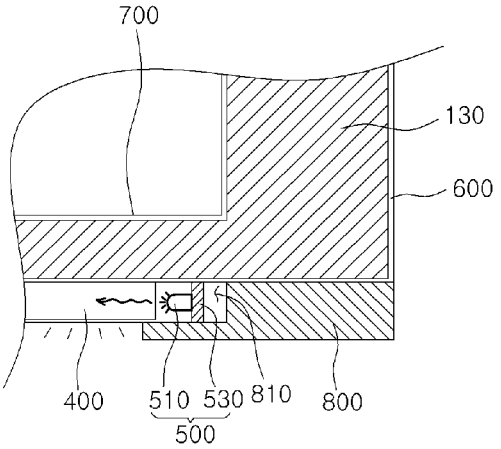
FIG. 6 is a cross-sectional view taken along line II-II' of FIG. 4.

FIG. 4 shows the appearance of a refrigerator according to a second embodiment of the present invention in a perspective view, FIG. 5 shows the construction of a refrigerator main body according to the second embodiment of the present invention in an exploded perspective view, and FIG. 6 shows a cross-section taken along line II-II' of FIG. 4.

Referring to FIGS. 4 to 6, the refrigerator 3 according to the second embodiment of the present invention includes a main body 20 in which a storage chamber 22 is formed, and a door 40 which closes the main body 20.

In detail, the door 40 is rotatably connected to an opened, upper surface of the main body 20. The door 40 selectively closes the opened, upper surface of the main body 20, i.e. the storage chamber 22, and the door 40 forms the appearance of an upper surface of the refrigerator 3 when it is closed.

The main body 20 includes an outer case 600 defining external appearance, an inner case 700 forming the storage chamber 22, an insulating material 130 interposed between the outer case 600 and inner case 700.

Also, an exterior member 400 defining external appearance is provided ahead of the outer case 600. The exterior member 400 forms a front appearance of the main body 20, and it may be made of transparent or semi-transparent material.

As described in the first embodiment, various patterns may be expressed on a surface of the exterior member 400. And, the patterns may be print-processed so that light can be transferred.

At the outer case 600, a mounting bracket 610 for guiding the installation of the exterior member 400 is provided. A plurality of mounting brackets 610 may be provided at both sides of the exterior member 400. Here, the mounting bracket 610 corresponds to the connection member of the first embodiment.

Further, the mounting bracket 610 is configured to accommodate both side ends of the exterior member 400. The exterior member 400 may be inserted between the plurality of mounting brackets 610.

On the contrary, the exterior member 400 may also be connected to a front surface of the main body 20 not by the mounting bracket 610 but by a separate adhesive or connecting element.

Also, a connection member 800 which connects the exterior member 400 to the main body 20 is provided at both sides of the exterior member 400.

The connection member 800 defines the appearance of a front surface and both side edges of the main body 20, and it is configured to engage with an end of the exterior member 400 or to cover both side ends of the exterior member 400.

Meanwhile, a display unit 33 is provided at an upper part of the exterior member 400, i.e. an upper part of the main body 20. The display unit 33 includes a video unit which displays the operational state of the refrigerator 3 and a plurality of input units which is able to input certain commands.

At one side of the display unit 33, a light-emitting means 500 for emitting light toward the exterior member 400 is provided.

In detail, the light-emitting means 500 includes a plurality of LEDs 510 for emitting light, and a board 530 on which the LEDs are mounted. The plurality of LEDs 510 are continually mounted on the board 530, and they are arranged at locations corresponding to the top of the exterior member 400 at regular intervals.

Also, the outer case 600 is provided with a mounting member 550 which allows the light-emitting means 500 to be installed at the outer case 600. The mounting member 550 is forwardly protruded from a front surface of the outer case 600, an accommodating space for receiving the light-emitting means 500 is formed in the mounting member 550.

The light-emitting means 500 may be disposed at one side of the exterior member 400 while being accommodated in the mounting member 550.

Meanwhile, the mounting member 550 may also be formed at the display unit 33 so that the light-emitting means 500 can be provided below the display unit 33.

Also, the light-emitting means 500 is provided at both sides of the exterior member 400.

Referring to FIG. 6, the exterior member 400 may be fixed to a front surface of the outer case 600 by the connection member 800. At least one side of the exterior member 400 may be connected to the connection member 800.

At one side of the exterior member 400, an exterior member accommodating portion 810 for receiving the exterior member 400 is formed. That is, the exterior member accommodating portion 810 is a space which is formed between the exterior member 400 and connection member 800.

On the exterior member accommodating portion 810, the light-emitting means 500 for emitting light toward the exterior member 400 is mounted. The light-emitting means 500 is disposed to emit light toward an end of the exterior member 400.

That is, since the light emitted from the light-emitting means 500 is not directly incident to the front but is incident in a longitudinal direction of the exterior member 400, and therefore this may prevent dazzling of users.

The operation of the refrigerator having the above-described configuration will be explained.

First, in case the intensity of illumination in a room where the refrigerator 3 is installed is high enough, the light-emitting means 500 is not operated because the patterns expressed on the exterior member 400 can be readily recognized.

However, in case the intensity of illumination in a room where the refrigerator 3 is installed is low, the light-emitting means 500 may be turned on. The control of the light-emitting means 500 may be automatically done by a sensor for detecting the intensity of illumination in a room, or it may also be done by On-Off operation of the users, as necessary.

If the light-emitting means 500 is turned on, the light from the LED 510 is incident on the end of the exterior member 400, and the incident light is transferred along the inside of the exterior member 400, thereby lightening up the whole or some part of the exterior member 400.

Here, the exterior member 400 may be print-processed in order to block light or to control the transmissivity of light. In this case, the light emitted to the outside via the front surface of the exterior member 400 can be controlled.

As described above, since an intense light from the light-emitting means 500 is not directly directed to the front and light is emitted through the exterior member 400, it can serve as an indirect light such as a mood lamp as well as the patterns expressed on the exterior member 400 can be further emphasized.

INDUSTRIAL APPLICABILITY

According to said refrigerator and refrigerator door, the location of the refrigerator door can be easily recognized as light is emitted from the exterior member by the light-emitting means, as well as it is possible to prevent dazzling of users as light is emitted through the end of the exterior member without exposing the exterior member, and therefore industrial applicability is deemed to exist therein.

The invention claimed is:

1. A door of a refrigerator, comprising:

a door assembly;

a glass member which is provided ahead of the door assembly, the glass member made of material which is transparent to emit light, the length of the glass member in a longitudinal direction being longer than that of the door assembly;

a patterned part having a pattern printed on a rear surface of the glass member;

a printed sheet provided to the patterned part and causing the patterned part to appear three-dimensional;

a decoration member attached to the printed sheet, the decoration member being crystal or cubic; and a connection member provided at a top portion of the door assembly and configured to connect the glass member to the door assembly, the connection member comprising:

a door fixing portion coupled to a top of the door assembly;

a module fixing portion configured to support an upper part of the glass member, the module fixing portion having a recess;

a light emitting diode (LED) module located across from an edge of the glass member in the recess of the module fixing portion, the LED module comprising a board installed in the recess and a plurality of light-emitting diodes that are mounted on the board and that are configured to emit light to the glass member; and a connection part extending upward from the door fixing portion to the recess of the module fixing portion such that the LED module is disposed at an upper side of the door assembly, wherein the glass member is configured to diffuse light to allow the pattern to stand out.

2. The door of the refrigerator according to claim 1, further comprising an assembly mounting portion defined between the door assembly and the connection member.

3. The door of the refrigerator according to claim 1, wherein the connection member includes a first connection member disposed at upper and lower ends of the door assembly, and a second connection member disposed at left and right ends of the door assembly.

4. The door of the refrigerator according to claim 1, wherein the plurality of light-emitting diodes are directed from an outer side end of the glass member to an inside thereof.

5. The door of the refrigerator according to claim 1, wherein the plurality of light-emitting diodes are provided to emit light from a first side of the glass member and a second side of the glass member, the first side of the glass member being opposite of the second side of the glass member.

6. The door of the refrigerator according to claim 1, wherein a connecting element for spacing a door handle apart from the door is provided in at least one side of a handle main body.

7. The door of the refrigerator according to claim 1, wherein the glass member is separated into a top portion and a bottom portion.

8. The door of the refrigerator according to claim 7, wherein a display unit separates the top portion and the bottom portion of the glass member.

9. The door of the refrigerator according to claim 1, wherein the connection member connects the glass member to a top end or a bottom end of the door.

10. The door of the refrigerator according to claim 1, wherein a thickness of the glass member in a direction toward the door assembly is substantially equal to a thickness of the module fixing portion in a direction toward the door assembly.

11. The door of the refrigerator according to claim 1, wherein a thickness of the glass member in a direction toward the door assembly is greater than a thickness of the plurality of light-emitting diodes in a direction toward the door assembly.

12. The door of the refrigerator according to claim 1, wherein the door assembly comprises a panel made of a steel plate having a rectangular shape, a door liner that defines an interior of the door assembly, and an insulating material between the panel and the door liner, wherein the glass member is positioned at the panel.

13. The door of the refrigerator according to claim 12:

wherein the panel includes a display mounting portion;

wherein the glass member comprises a first glass member positioned above the display mounting portion and a second glass member positioned below the display mounting portion, further comprising:

a display unit installed at the display mounting portion and positioned between the first glass member and the second glass member.

14. The door of the refrigerator according to claim 1, further comprising a sensor configured to detect an intensity of illumination at a site where the door of the refrigerator is located, wherein the plurality of light-emitting diodes are turned on based on the intensity of illumination sensed by the sensor being lower than a predetermined value, and wherein the plurality of light-emitting diodes are turned off based on the intensity of illumination sensed by the sensor being higher than the predetermined value.

* * * * *